United States Patent [19]

Bearden, Jr. et al.

[11] 4,330,392

[45] May 18, 1982

[54] HYDROCONVERSION PROCESS

[75] Inventors: Roby Bearden, Jr.; Clyde L. Aldridge; William C. Baird, Jr., all of Baton Rouge, La.

[73] Assignee: Exxon Research & Engineering Co., Florham Park, N.J.

[21] Appl. No.: 182,508

[22] Filed: Aug. 29, 1980

[51] Int. Cl.[3] ..... C10G 1/06; C10G 47/04; C10G 47/02

[52] U.S. Cl. ..... 208/10; 208/108; 208/112

[58] Field of Search ..... 208/10, 108, 112

[56] References Cited

U.S. PATENT DOCUMENTS

| | | | |
|---|---|---|---|
| 2,057,629 | 10/1936 | Morrell et al. | 208/225 |
| 2,119,647 | 6/1938 | Pier et al. | 208/10 |
| 3,123,550 | 3/1964 | Skomoroski et al. | 208/213 X |
| 3,131,142 | 4/1964 | Mills, Jr. | 208/108 |
| 3,232,861 | 2/1966 | Gorin et al. | 208/10 X |
| 3,282,828 | 11/1966 | Gleiw | 208/264 |
| 3,700,583 | 10/1972 | Solamony et al. | 208/8 |
| 4,038,173 | 7/1977 | Myers | 208/112 |
| 4,077,867 | 3/1978 | Aldridge et al. | 208/10 |
| 4,169,041 | 9/1979 | Schuette | 208/108 |
| 4,192,735 | 3/1980 | Aldridge et al. | 208/108 X |
| 4,203,759 | 5/1980 | Metrailer et al. . | |
| 4,204,943 | 5/1980 | Metrailer et al. | 208/50 |

FOREIGN PATENT DOCUMENTS

| | | | |
|---|---|---|---|
| 18642 | 7/1934 | Australia | 208/10 |
| 457211 | 11/1936 | United Kingdom | 208/10 |
| 463602 | 4/1937 | United Kingdom | 208/10 |

*Primary Examiner*—Delbert E. Gantz
*Assistant Examiner*—William G. Wright
*Attorney, Agent, or Firm*—Marthe L. Gibbons

[57] ABSTRACT

Nitrogen-containing carbonaceous feeds such as hydrocarbonaceous oils and coal are hydroconverted in the presence of a solid vanadium-containing catalyst and a hydrogen halide.

9 Claims, 1 Drawing Figure

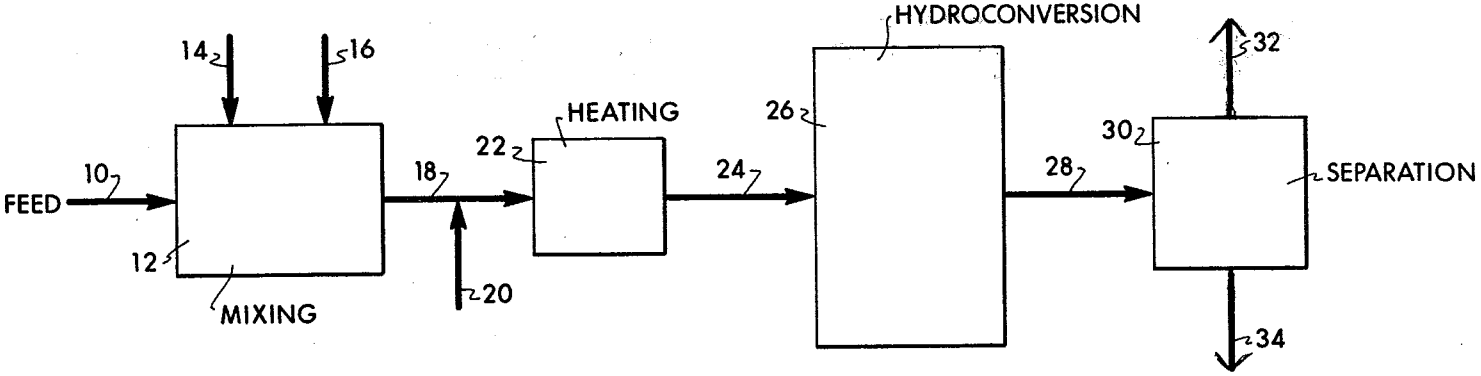
FEED
10
12
MIXING
14
16
18
20
22
HEATING
24
26
HYDROCONVERSION
28
30
SEPARATION
32
34

HYDROCONVERSION PROCESS

BACKGROUND OF THE INVENTION

1. Field of the Invention

The present invention relates to an improvement in a process for the conversion of nitrogen-containing carbonaceous feeds such as a hydrocarbonaceous oil, coal or mixtures thereof in the presence of hydrogen and a vanadium-containing catalyst.

2. Description of the Prior Art

Hydroconversion processes conducted in the presence of hydrogen and a hydroconversion catalyst are well known.

The term "hydroconversion" is used herein to designate a process conducted in the presence of hydrogen in which at least a portion of the heavy constituents (as measured by Conradson carbon residue) of the feedstock is converted to lower boiling constituents. The concentration of nitrogenous contaminants, sulfur contaminants and metallic contaminants of the feed may also be simultaneously decreased.

U.S. Pat. No. 3,123,550 discloses the addition of mineral acids to distillate chargestocks of a hydrotreating process utilizing a conventional hydrogenation catalyst.

U.S. Pat. No. 3,282,828 discloses hydrorefining of petroleum crude oils utilizing an unsupported vanadium halide.

U.S. Pat. No. 2,057,629 discloses the refining of hydrocarbon oils with hydrochloric acid in the presence of a metal oxide which may be a vanadium oxide.

U.S. Pat. No. 3,700,583 discloses coal liquefaction in a hydrogen donor solvent in the presence of a carbon radical scavenger which may be a hydrogen halide.

It has now been found that a hydroconversion process of nitrogen-containing carbonaceous feeds utilizing a combination of a vanadium-containing catalyst and a hydrogen halide will provide advantages that will become apparent in the following description.

SUMMARY OF THE INVENTION

In accordance with the invention there is provided, in a hydroconversion process wherein a nitrogen-containing carbonaceous feed is contacted with a particulate vanadium-containing catalyst in the presence of added hydrogen at hydroconversion conditions in a hydroconversion zone, the improvement which comprises, hydroconverting said feed in the presence of a hydrogen halide in a mole ratio of 0.2:1 to 2.0:1 of said hydrogen halide to nitrogen in said feed.

BRIEF DESCRIPTION OF THE DRAWING

The FIGURE is a schematic flow plan of one embodiment of the invention.

DESCRIPTION OF THE PREFERRED EMBODIMENT

The process of the invention is generally applicable for the hydroconversion of nitrogen-containing carbonaceous feeds such as heavy hydrocarbonaceous oils having constituents boiling above about 1050° F., coal and mixtures thereof. Suitable heavy hydrocarbonaceous oil feeds include heavy mineral oils; crude petroleum oils, including heavy crude oils; residual oils such as atmospheric residuum and vacuum residuum; tar; bitumen; tarsand oils; shale oils; liquid products derived from coal liquefaction processes, including coal liquefaction bottoms, and mixtures thereof. All boiling points referred to herein are atmospheric pressure boiling points unless otherwise specified. The term "coal" is used herein to designate all ranks of coal such as anthracite coal, bituminous coal, semibituminous coal, subbituminous coal, lignite, peat and mixtures thereof. The process is applicable for the simultaneous conversion of mixtures of coal and a hydrocarbonaceous oil. The carbonaceous feeds utilized in the process of the present invention contain nitrogen contaminants corresponding to at least about 100 wppm nitrogen and may contain nitrogen contaminants up to about 5 weight percent nitrogen; up to 8 weight percent sulfur contaminants, calculated as elemental sulfur, and up to about 2000 wppm or more metallic contaminants, calculated as elemental metals. The Conradson carbon residues of said feeds generally are at least 2 weight percent, preferably at least 5 weight percent (as to Conradson carbon residue, see ASTM test D 189-65). The process is particularly well suited to convert non-distillate oils such as vacuum residua.

Although in the preferred embodiment the hydroconversion is described as a slurry operation, the process may also suitably be conducted with a catalyst contained in a fixed bed, a moving bed, a fluidized bed, an ebullated bed, etc.

Referring to the figure, a nitrogen-containing carbonaceous feed is introduced by line 10 into mixer 12. When coal is used as carbonaceous feed, the coal would be present as coal particles in a liquid medium which may be an organic diluent, including heavy hydrocarbonaceous oils. A particulate solid vanadium-containing hydroconversion catalyst is introduced into mixer 12 by line 14 to disperse the finely divided catalyst particles in the oil feed, or in the liquid medium of a coal slurry.

The vanadium-containing catalyst can be any solid hydroconversion catalyst such as an unsupported or a supported vanadium catalyst component, for example vanadium oxide or vanadium sulfide. The support may be a conventional refractory oxide such as silica, alumina, silica-alumina; carbon, etc. Preferably, the vanadium-containing catalyst is derived from gasification of vanadium-containing coke or vanadium-containing ash derived by burning coke gasification residue, such as, for example, the vanadium-containing ash produced in the process of U.S. patent application Ser. No. 901,700 now U.S. Pat. No. 4,203,759, the vanadium-containing catalyst used in the hydroconversion process of U.S. Pat. No. 4,169,038 and of U.S. application Ser. No. 942,689 now U.S. Pat. No. 4,204,943, the teachings of all of which are hereby incorporated by reference.

Suitable concentrations of the catalyst in the oil range from about 0.1 to about 5 weight percent, preferably from about 0.2 to about 2.0 weight percent, calculated as the elemental metal, based on the oil feed. The catalyst particle size may range from about 0.5 to 15 microns, preferably from about 1 to about 10 microns in diameter.

A hydrogen halide, preferably hydrogen chloride or a hydrogen halide precursor such as, for example, the halogens, alkyl halides or aryl halides, is introduced into mixer 12 by line 16 such as to provide a mole ratio of hydrogen halide to feed nitrogen ranging from about 0.2:1 to about 2.0:1, preferably from about 0.5:1 to 1.5:1. It is to be understood that the hydrogen halide could be added to the feed in line 10 instead of being introduced directly into the mixer or it may be added directly to hydroconversion reactor 26.

The heavy oil-catalyst-hydrogen halide mixture is removed from mixer 12 by line 18. A hydrogen-containing gas is introduced into the mixture by line 20. The hydrogen-containing gas may additionally comprise from about 1 to about 10 mole percent hydrogen sulfide. The oil-catalyst-hydrogen halide-hydrogen mixture is then passed to heater 22 where the mixture is preheated. The preheated mixture is removed by line 24 and passed to the hydroconversion zone in reactor 26. The hydroconversion reaction zone in reactor 26 is maintained at a temperature ranging from about 600° to about 850° F., preferably from about 700° to about 800° F., and at a hydrogen partial pressure ranging from about 500 to about 5000 psig, preferably from about 1000 to about 3000 psig. Optionally, hydrogen sulfide may be added to the hydroconversion zone.

The contact time may vary widely depending on the desired conversion level. Suitable contact times may range broadly from about 0.1 to 10 hours, preferably from about 0.15 to 4 hours, more preferably from about 0.5 to 2.0 hours. The mixed phase product effluent of the hydroconversion zone is removed from reactor 26 by line 28 and passed to separator 30 wherein it is separated by conventional means into a predominantly vaporous phase comprising light, normally gaseous hydrocarbons and hydrogen, removed by line 32 and a principally liquid phase removed by line 34. The vaporous phase may be further separated by conventional means to obtain a hydrogen-rich gas, which, if desired, may be recycled to the hydroconversion zone 26. The normally liquid hydrocarbon phase may be separated into fractions, as is well known in the art. For example, the normally liquid hydrocarbon phase may be separated into a naphtha stream, a middle distillate stream and a residual fraction containing the particulate catalyst. If desired, at least a portion of the residual fraction containing the catalyst may be recycled to the hydroconversion process. Furthermore, it is also possible to separate the catalyst from the reactor effluent or from a concentrated product residual stream by conventional means known in the art, such as by filtration, centrifugation, settling and drawoff. If desired, at least a portion of the separated catalyst may be recycled to the process.

The following examples are presented to illustrate the invention.

EXAMPLE 1

Experiments were made utilizing as feed a topped Cold Lake crude oil having a nitrogen content of 0.56 weight percent, a sulfur content of 5.6 weight percent, a Conradson carbon content of 19.0 weight percent and an initial atmospheric pressure boiling point of 850° F. The catalyst used was a vanadium-rich ash (43.6 wt. % vanadium) resulting from the burning of a vanadium-containing, partially gasified coke.

The experiments were carried out in the following manner. A 300 cc stirred autoclave was charged with 95.0 g of topped Cold Lake crude, 2.5 g of ash catalyst and a gas charge comprising 50 psia hydrogen sulfide and 2000 psig hydrogen (at room temperature). The reactor was then heated to 725° F. for a 30 minute stirred contact after which the reactor was cooled to 300° F. At this point, gases were vented off and the reactor was flushed with hydrogen. This completed the pretreatment step of the experiment. Next, upon cooling to room temperature, the reactor was charged with the desired quantity of anhydrous hydrogen chloride gas and 2000 psig of hydrogen. The reactor was then heated to 800° F. for a two-hour stirred contact, cooled to room temperature and vented to recover gaseous products. The reactor contents were subsequently filtered to recover liquid and solid products for analysis.

Experimental results are shown in Table I. In Run No. R-710, there was no addition of HCl to the reactor. In Run No. R-706, which is a run in accordance with the process of the present invention, 1.0 weight percent anhydrous hydrogen chloride was added, based on oil feed weight. This amount gave an HCl to feed nitrogen mole ratio of 0.67.

TABLE I

TOPPED COLD LAKE CRUDE OIL HYDROCONVERSION WITH VANADIUM-ASH + HCl

| Run No. | R-710 | R-706 |
|---|---|---|
| Wt. % Vanadium on Feed | 1.15 | 1.15 |
| Wt. % HCl on Feed | None | 1.0 |
| HCl/Feed-N mole ratio | — | 0.67 |
| Yield, $C_1$–$C_4$, Wt. % | 1.7 | 2.1 |
| Yield, Coke, Wt. % | 0.1 | 0.5 |
| Desulfurization, Wt. % | 33 | 44 |
| Denitrogenation, Wt. % | 2 | 35 |
| Conradson Carbon Conversion, Wt. % | 37 | 62 |

As can be seen from Table I, the addition of HCl accelerated the conversion rate, as shown by higher levels of Conradson carbon conversion, sulfur removal and nitrogen removal.

EXAMPLE 2

A second set of experiments was made utilizing the topped Cold Lake crude of Example 1 and the vanadium-rich ash catalyst of Example 1. The objective was to compare overall hydroconversion performance for HCl-containing and HCl-free hydroconversion runs that were designed to give the exact same level of Conradson carbon conversion. The experimental procedure used was identical to that of Example 1, except that different temperatures and contact times were employed in the hydroconversion step of the experiments. Experimental conditions and results are shown in Table II. In Run No. R-612 there was no addition of HCl to the reactor. In Run No. R-714, which is a run in accordance with the process of the present invention, 2 weight percent anhydrous hydrogen chloride was added, based on the weight of oil feed. This amount gave an HCl to feed nitrogen mole ratio of 1.4

TABLE II

TOPPED COLD LAKE CRUDE OIL HYDROCONVERSION WITH VANADIUM-ASH + HCl

| | Run R-612 | Run R-714 |
|---|---|---|
| Wt. % Vanadium on Feed | 1.15 | 1.15 |
| Wt. % HCl on Feed | 0 | 2 |
| HCl/Feed-N mole ratio | — | 1.4 |
| Contact Time, Min. | 150 | 240 |
| Temp., °F. | 820 | 725 |
| Yield, $C_1$–$C_4$, Wt. % | 5.5 | 2.3 |
| Yield, Coke, Wt. % | 0.8 | 0.7 |
| Conradson carbon Conversion, Wt. % | 70 | 70 |
| Denitrogenation, Wt. % | <10 | 78 |
| Desulfurization, Wt. % | 64 | 73 |
| $H_2$ Consumption, SCF/B[1] | 1365 | 1040 |

[1]SCF/B = standard cubic feet per barrel of oil

As can be seen from Table II, Run No. R-714 utilizing HCl gave improved denitrogenation and desulfurization at conditions carefully chosen to give Conradson carbon conversion equivalent to that obtained in Run No. R-612. Furthermore, the hydrogen consumption in Run No. R-714 was substantially lower than in Run No. R-612.

What is claimed is:

1. In a hydroconversion process wherein a nitrogen-containing carbonaceous feed is contacted with a particulate vanadium-containing catalyst in the presence of added hydrogen at hydroconversion conditions in a hydroconversion zone, the improvement which comprises: hydroconverting said feed in the presence of a hydrogen halide in a mole ratio of 0.2:1 to 2.0:1 hydrogen halide to nitrogen in said feed, and said vanadium-containing catalyst being present in an amount ranging from about 0.1 to about 5 weight percent, calculated as elemental vanadium, based on said feed.

2. The process of claim 1 wherein said mole ratio ranges from about 0.5:1 to about 1.5:1 hydrogen halide to nitrogen in said feed.

3. The process of claim 1 wherein said hydrogen halide is hydrogen chloride.

4. The process of claim 1 wherein said hydroconversion conditions include a temperature ranging from about 600° to about 850° F. and a hydrogen partial pressure ranging from about 500 to about 5000 psig.

5. The process of claim 1 wherein said vanadium-containing catalyst is selected from the group consisting of vanadium oxide, vanadium sulfide, and mixtures thereof.

6. The process of claim 1 wherein said vanadium-containing catalyst comprises partially gasified vanadium-containing coke or vanadium-containing metallic ashes derived from burning said partially gasified coke.

7. The process of claim 1 wherein said carbonaceous feed comprises a hydrocarbonaceous oil having constituents boiling above about 1050° F. at atmospheric pressure.

8. The process of claim 1 wherein said carbonaceous feed comprises coal.

9. In a hydroconversion process wherein a nitrogen-containing carbonaceous feed is contacted with a particulate vanadium-containing catalyst selected from the group consisting of partially gasified vanadium-containing coke and vanadium-containing metallic ash derived from burning said partially gasified vanadium-containing coke, in the presence of added hydrogen at hydroconversion conditions, including a temperature ranging from about 600° to about 850° F., a hydrogen partial pressure ranging from about 500 to about 5000 psig, in a hydroconversion zone, the improvement which comprises: hydroconverting said feed in the presence of hydrogen chloride in a mole ratio of about 0.5:1 to about 1.5:1 hydrogen chloride to feed nitrogen.

* * * * *